United States Patent [19]

Irie

[11] 3,982,805

[45] Sept. 28, 1976

[54] ELECTRICAL CONNECTOR AND HOUSING THEREFOR

[75] Inventor: Norimitsu Irie, Kawasaki, Japan

[73] Assignee: AMP Incorporated, Harrisburg, Pa.

[22] Filed: Nov. 21, 1975

[21] Appl. No.: 634,109

[30] Foreign Application Priority Data

Nov. 29, 1974 Japan ..... 49-143849[U]

[52] U.S. Cl. ..... 339/59 R; 339/217 S

[51] Int. Cl.[2] ..... H01R 13/40

[58] Field of Search ..... 339/59, 217

[56] References Cited

UNITED STATES PATENTS

| | | | |
|---|---|---|---|
| 3,562,698 | 2/1971 | Merry | 339/217 S |
| 3,634,811 | 1/1972 | Teagno | 339/59 M |
| 3,699,502 | 10/1972 | Carter | 339/217 S |

*Primary Examiner*—Joseph H. McGlynn
*Attorney, Agent, or Firm*—Allan B. Osborne

[57] ABSTRACT

A housing for an electrical terminal of the type having a resilient locking tongue with a rearwardly directed free end, which housing is molded from plastics material with a terminal-receiving passageway open to a rear of the housing and a locking abutment having a forward face engageable by the free end of the locking tongue in a snap fit on insertion of the terminal front first into the passageway from the housing rear, and a resilient tongue pusher extending across the passageway forward of the abutment face and engageable behind the tongue to retain the free end of the tongue in alignment with the abutment face.

5 Claims, 3 Drawing Figures

FIG.1.
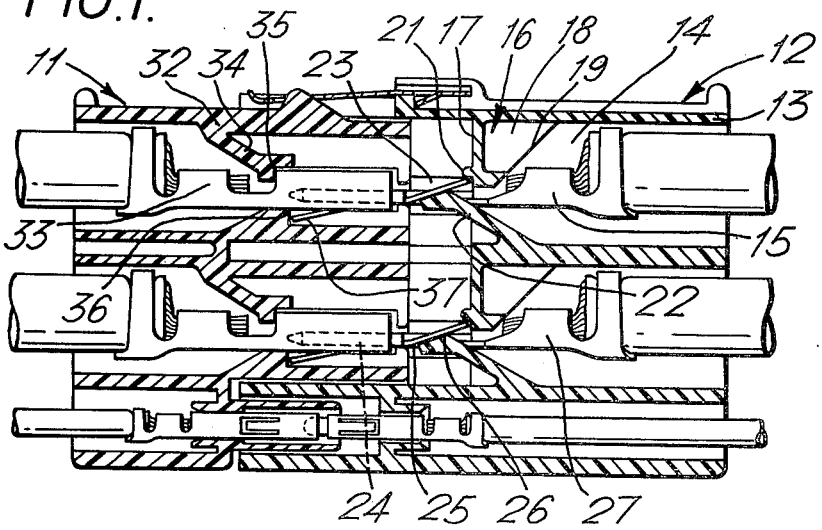
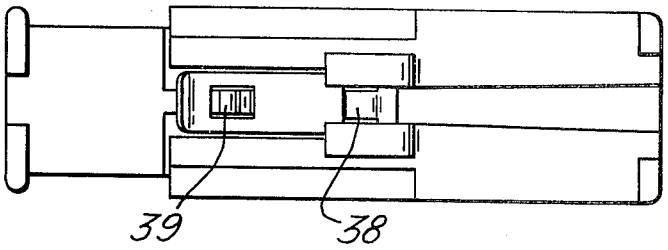
FIG.2.
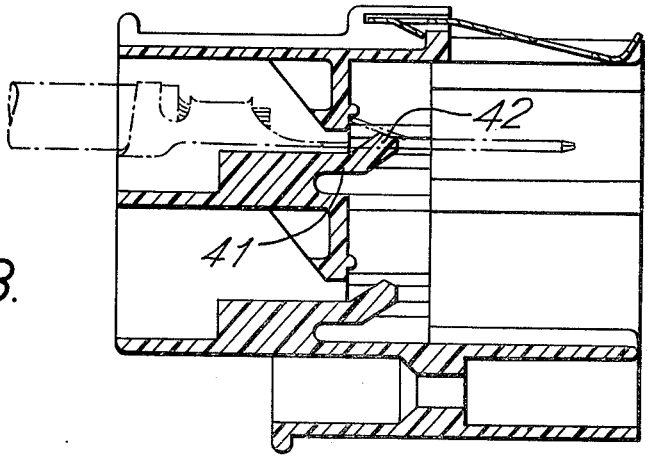
FIG.3.

ELECTRICAL CONNECTOR AND HOUSING THEREFOR

The invention relates to electrical connectors and housings.

According to the invention, a housing for an electrical terminal of the type having a resilient locking tongue with rearwardly directed free end, which housing is molded from plastics material with a terminal-receiving passageway open to a rear of the housing and a locking abutment having a forward face engageable by the free end of the locking tongue in a snap fit on insertion of the terminal front first into the passageway from the housing rear has a resilient tongue pusher extending across the passageway forward of the abutment face and engageable behind the tongue to retain the free end of the tongue in alignment with the abutment face.

The invention also includes an electrical connector comprising a housing molded in one piece from plastics material with a terminal-receiving through passageway open to a rear of the housing for insertion of the terminal, a locking abutment extending from one wall of the passageway and a tongue pusher comprising a resilient arm extending from an opposite wall forwardly across the passageway and inclined to the passageway axis with its free end located forward of the abutment face; an electrical terminal having a forward contact portion and a resilient locking tongue with a rearwardly extending free end being received between the locking abutment and the tongue pusher with the contact portion located forward of the tongue pusher, the free end of the locking tongue engaging a forward face of the locking abutment in a snap fit and the free end of the tongue pusher engaging behind the tongue to retain the free end of the tongue in alignment with the abutment face.

Specific examples of the invention will now be described with reference to the accompanying drawing in which:

FIG. 1 is a side view of an electrical connector assembly including a female connector according to the invention with the connector housings shown in cross-section; and, FIG. 2 is a plan view of th connectors; and, FIG. 3 is a cross-sectional view of a second example of connector housing according to the invention with a terminal shown in dash-dot lines.

The connector assembly shown in FIGS. 1 and 2 comprises a male connector 11 mated with a female connector 12.

The female connector comprises a housing 13 molded in one piece from plastics material with a plurality of throughpassageways 14 open at front and rear faces of the housing in each of which is recived an electrical terminal 15. A locking abutment 16 extends across each passageway from an upper wall and comprises a front face 17 perpendicular to the passageway axis and two parallel supporting walls 18 extending rearwardly from opposite sides of the front face and with rear edges 19 inclining rearwardly and outwardly of the passageway axis. A horizontal rib 21 is formed on the front face 17. A tongue pusher 2 comprising a resilient arm extends from a lower wall forwardly across the passageway and inclined to the passageway axis with its free end located forward of the abutment face. Terminal guide channels defined by rails 23 are provided in opposite sidewalls of the passageways.

The electrical terminals 15 are stamped and formed from sheet metal stock and comprise a forward tab portion 24 an intermediate body portion 25 from which is struck a locking tongue 26 with a rearwardly directed free end, and a rear wire-receiving ferrule 27.

The terminal is inserted into the passageway through the open rear between the locking abutment and the tongue pusher with opposite edges of the body portion being received in the guide. Laterally extending tabs (not shown) are provided on opposite edges of the terminal body and engage steps on the housing wall in a known manner to prevent over insertion of the terminal. Over insertion may also be prevented by engagement of the wire-receiving ferrule with the rear edges 99 of the abutment.

On insertion, the locking lance engages the forward face of the abutment in a snap-fit, excessive movement of the lance away from the body being prevented by the rib 21. The tongue pusher is flexed away from the abutment by the tab portion and springs back into an aperture in the body formed by striking out the locking tongue to engage behind the tongue thereby preventing the end of the tongue being pushed out of alignment with the abutment face during normal handling and use of the connector or arising as a result of insufficient resiliency or location of the tongue.

The male connector 11 comprises a housing 31 molded in one piece from insulating material with through passageways 32 each receiving a socket-type electrical terminal 33. A resilient locking finger 34 having a notch 35 at a free end extends forwardly from an upper wall of the passageway and a retention shoulder 35 is formed on the opposite wall. The terminal is of known type having spring rolls extending from opposite edges of a web and a resilient locking tongue 37 extending rearwardly from the web. On insertion of the terminal into the passageway, the locking tongue and finger flex to admit the terminal and subsequently the tongue and finger engage the shoulder and the spring rolls respectively in a snap-fit to prevent withdrawal. Stop means may be provided in known manner to prevent over insertion of the terminal.

The connectors 11 and 12 are secured together on mating by cooperation between a spring catch 38 and projection 39 on respective connectors.

In an alternative connector shown in FIG. 3, the tongue pusher is of stronger construction having an axial portion 41 extending from a relative large block of material and a relatively short inclined portion 42 at its free end. The free end of the tongue is formed with inclined facets to engage behind the tongue and aperture edge respectively.

What is claimed is:

1. A housing for an electrical terminal of the type having a resilient locking tongue with a rearwardly directed free end, which housing is molded from plastics material with a terminal-receiving passageway open to a rear of the housing and a locking abutment having a forward face engageable by the free end of the locking tongue in a snap fit on insertion of the terminal front first into the passageway from the housing rear, and a resilient tongue pusher extending across the passageway forward of the abutment face and engageable behind the tongue to retain the free end of the tongue in alignment with the abutment face.

2. A housing according to claim 1 in which the tongue pusher and locking abutment extend from opposite walls of the passageway and the tongue pusher comprises an arm inclined to the passageway axis.

3. A housing according to claim 1 in which a seat for the free end of the locking tongue is provided on the abutment face.

4. An electrical connector comprising a housing molded in one piece from plastics material with a terminalreceiving through passageway open to a rear for insertion of the terminal, a locking abutment extending from one wall of the passageway and a tongue pusher comprising a resilient arm extending from an opposite wall forwardly across the passageway and inclined to the passageway axis with its free end located forward of the abutment face; an electrical terminal having a forward contact portion and a resilient locking tongue with a rearwardly extending free end being received between the locking abutment and the tongue pusher with the contact portion located forward of the tongue pusher, the free end of the locking tongue engaging a forward face of the locking abutment in a snap fit and the free end of the tongue pusher engaging behind the tongue to retain the free end of the tongue in alignment with the abutment face.

5. An electrical connector according to claim 4, in which the locking tongue is struck from a body portion of the terminal defining in such body portion an aperture through which the free end of the tongue pusher extends.

* * * * *